US011326614B2

(12) United States Patent
Park

(10) Patent No.: US 11,326,614 B2
(45) Date of Patent: May 10, 2022

(54) AUTOMATIC FLUID PUMP

(71) Applicant: Dukshin Corp., Ltd., Incheon (KR)

(72) Inventor: Kyung Suh Park, Suwon-si (KR)

(73) Assignee: DUKSHIN CORP., LTD., Incheon (KR)

( * ) Notice: Subject to any disclaimer, the term of this patent is extended or adjusted under 35 U.S.C. 154(b) by 92 days.

(21) Appl. No.: 17/007,628

(22) Filed: Aug. 31, 2020

(65) Prior Publication Data

US 2021/0156389 A1 May 27, 2021

(30) Foreign Application Priority Data

Nov. 27, 2019 (KR) ..... 10-2019-0154363

(51) Int. Cl.
*F04D 29/08* (2006.01)
*F04D 15/00* (2006.01)
*F04D 27/00* (2006.01)

(52) U.S. Cl.
CPC ..... *F04D 27/009* (2013.01); *F04D 29/08* (2013.01); *F04D 29/086* (2013.01); *F04D 15/0083* (2013.01)

(58) Field of Classification Search
CPC . F04D 3/00; F04D 3/005; F04D 15/00; F04D 15/0005; F04D 15/0011; F04D 29/08; F04D 29/086; F04D 29/708; F04D 15/0083; F04F 10/00; F04B 15/00; F04B 15/02; F04B 15/023
See application file for complete search history.

(56) References Cited

FOREIGN PATENT DOCUMENTS

KR 100309598 B1 * 9/2001 ..... F04D 13/06

* cited by examiner

*Primary Examiner* — Richard A Edgar
*Assistant Examiner* — Jason G Davis
(74) *Attorney, Agent, or Firm* — Kirton McConkie; Evan R. Witt

(57) ABSTRACT

An automatic fluid pump includes a pump body having a liquid channel and a mounting channel, the liquid channel having an inlet and an outlet and connected to a suction pipe and a delivery hose, respectively. A motor fan is disposed at a lower end of the suction pipe. A power controller is coupled to the pump body and circuit-connected to a battery, a terminal plate, and a switch. A valve case is coupled to the mounting channel in the form of a hopper formed at a lower end thereof with an inclined portion having an air hole. A valve case cap is coupled to the valve case. A main check valve is disposed on a lower surface of the valve case cap to open/close the through-holes. An auxiliary check valve is vertically moved up and down between the mounting channel and the air hole to open/close the air hole.

5 Claims, 4 Drawing Sheets

AUTOMATIC FLUID PUMP

TECHNICAL FIELD

The present invention relates to an automatic fluid pump and, more particularly, to an automatic fluid pump which draws in and delivers fluid using a motor as a source of motive power and can eliminate a need for a fluid recovery line for recovery of overflowing fluid as in the related art by allowing up to a certain amount of the fluid to be introduced into a fluid retention portion throughout pumping operation.

BACKGROUND ART

In general, an automatic fluid pump is a device that draws in fluid from a fluid reservoir using suction force generated by rotation of a suction fan driven by a motor and discharges the fluid through an outlet.

Such an automatic fluid pump includes: a main body including an elongated suction pipe mounted at a leading end thereof to be inserted into a fluid reservoir, a battery chamber disposed above the suction pipe to receive a battery therein, and an outlet formed at one side thereof; a suction pumping unit connected to an inside of the main body and drawing fluid into the main body using suction force obtained by rotating a motor-driven suction fan disposed inside the suction pipe through user switch operation; a securing portion disposed halfway between the main body and the suction pipe to secure the main body to an entrance of the fluid reservoir; and a delivery hose adapted to discharge the fluid therethrough.

With this structure, the automatic fluid pump has an air hole formed at one side of the suction pipe to remove fluid remaining in the suction pipe and a discharge pipe of the fluid pump using the siphon effect after pumping operation.

That is, with the air hole formed at an outer side of the suction pipe to introduce external air therethrough, the automatic fluid pump allows fluid to fall along the suction pipe by air introduced through the air hole upon occurrence of overflow or during fluid removal operation using the siphon effect after pumping operation.

In addition, when the fluid pump is operated in a manual pumping mode, the remaining fluid is removed using the siphon effect after pumping operation by opening an air vent cap formed at an upper portion of the main body to supply external air into the main body.

As an example of such an automatic fluid pump known in the art, Korean Patent Laid-open Publication No. 1999-0078583 (Patent Document 1) (filed earlier by the present applicant, published on Nov. 5, 1999, entitled "Fluid Pump") discloses a fluid pump that can prevent fluid from falling along a suction pipe during pumping operation or upon occurrence of overflow with an air groove formed inside a pump body.

In addition, Korean Patent Laid-Open Publication No. 2001-0017713 (Patent Document 2) (filed earlier by the present applicant, published on Mar. 5, 2001, entitled "Fluid Pump") discloses a fluid pump that can prevent overflow during pumping operation with a fluid recovery unit disposed at one side of a fluid retention portion disposed inside a pump body to recover fluid from the fluid retention portion and can guide fluid flowing into and having remained in a hopper to a remaining fluid discharge portion when the amount of the fluid exceeds a certain value.

PRIOR ART DOCUMENTS

Patent Documents (Patent document 1) Korean Patent Laid-open Publication No. 1999-0078583 (published on Nov. 5, 1999, entitled "Fluid Pump")

(Patent document 2) Korean Patent Laid-open Publication No. 2001-0017713 (published on Mar. 5, 2001, entitled "Fluid Pump")

SUMMARY

As described above, such a typical automatic fluid pump includes an air hole at one side of a suction pipe to remove fluid remaining in a main body after pumping operation or to prevent overflow that can occur during pumping operation. However, since the fluid flows down along the suction pipe by air introduced through the air hole during fluid removal operation or upon occurrence of overflow, the automatic fluid pump has problems of poor appearance and easy contamination of the suction pipe.

In addition, since external air is supplied through the air hole formed at one side of the suction pipe, it takes lots of time to discharge fluid during fluid removal operation or upon occurrence of overflow.

Further, in a fluid pump as disclosed in Patent Document 1, which includes an air groove formed in a pump body to prevent overflow, upon occurrence of overflow due to back pressure or the like, fluid is retained inside the main body before being discharged. Accordingly, when the fluid pump is used for a long time, intrusion of moisture and the like into a battery chamber or a board is likely to occur, affecting operation of the entire system.

Further, a fluid pump as disclosed in Patent Document 2 has a problem in that, upon adhesion of a large amount of foreign matter to a shutter, which is a check valve, a large amount of fluid is introduced into a fluid retention portion due to reduction in sealing force, causing increase in amount of remaining fluid to be discharged and reduction in pumping power.

Embodiments of the present invention have been conceived to overcome such problems in the art and it is one aspect of the present invention to provide an automatic fluid pump which allows smooth inflow of external air without an air groove in a pump body as in Patent Document 1, and can prevent overflow due to back pressure or intrusion of foreign substances by allowing up to a certain amount of fluid to be introduced into a fluid retention portion throughout pumping operation.

It is another aspect of the present invention to provide an automatic fluid valve which can effectively maintain internal pressure of a valve case by dual valve action of a main check valve and an auxiliary check valve, thereby providing improved sealing force.

It is a further aspect of the present invention to provide an automatic fluid valve which can maintain firm engagement between a valve case and a valve case cap provided with a main check valve and allows external air to be smoothly introduced through the main check valve in a switch-off mode of the pump.

In accordance with one aspect of the present invention, an automatic fluid pump includes: a pump body including a liquid channel and a mounting channel disposed at an upper side of the liquid channel, the liquid channel having an inlet and an outlet formed at opposite ends thereof and connected to a suction pipe and a delivery hose, respectively; a motor fan disposed at a lower end of the suction pipe to direct fluid to the liquid channel; a power controller coupled to the pump body and circuit-connected to a battery, a terminal plate, and a switch to control operation of the motor fan; a valve case coupled to the mounting channel and provided in the form of a hopper having a wall and an inclined portion having an air hole; a valve case cap coupled to the valve case and having multiple through-holes; and a main check valve disposed on a lower surface of the valve case cap to open/close the through-holes, the main check valve allowing internal pressure of the valve case to remain constant during pumping operation.

The automatic fluid pump may further include an auxiliary check valve disposed in a guide tube to be movable up and down to open/close the air hole, whereby sealing force is improved by dual action of the main check valve and the auxiliary check valve.

The valve case may include a first contact portion and a second contact portion formed on a lower surface of the inclined portion and contacting a mountain-shaped protrusion of the auxiliary check valve and the auxiliary check valve, respectively, the first contact portion having a different height than the second contact portion, and the auxiliary check valve may include a guide portion formed at a lower surface thereof and fitted at one end thereof into the mounting channel to guide vertical movement of the auxiliary check valve.

A locking protrusion and a locking groove corresponding each other may be formed on the wall of the valve case and an outer wall surface of the valve case cap, respectively, to maintain firm engagement between the valve case and the valve case cap, and the valve case cap may be provided with an O-ring for sealing to maintain the internal pressure of the valve case. In addition, the valve case cap may have multiple vent grooves formed therein to generate an air passage between the valve case cap and the terminal plate.

According to the present invention, when fluid is introduced into a space (fluid retention portion) in the valve case having the valve case cap mounted thereon and filled with air during pumping operation, air pressure in the space gradually increases until reaching a certain value, at which no more fluid is introduced into the space, thereby allowing up to a certain amount of the fluid to be introduced into the space and thus effectively preventing overflow.

In addition, with the auxiliary check valve further provided in addition to the main check valve, sealing force can be further improved by dual check valve action, thereby effectively preventing occurrence of overflow due to back pressure or excessive intrusion of foreign matter as in the related art.

Further, when the auxiliary check valve is moved up vertically to a closed position, the mountain-shaped protrusion of the auxiliary check valve and the auxiliary check valve closely contact the first and second contact portions formed on the valve case and having different heights, respectively, thereby improving sealing force of the auxiliary check valve.

Furthermore, when the pump is in a switch-off mode, external air can be smoothly introduced into the valve case through the main check valve, whereby fluid remaining in the valve case can be quickly recovered through the air hole while washing foreign matter off of the auxiliary check valve.

DRAWINGS

DETAILED DESCRIPTION

It should be understood that embodiments described herein are provided for illustration only and are not to be construed in any way as limiting the present invention.

It should be understood that the following embodiments may be embodied in a variety of other forms, and various omissions, substitutions and changes may be made without departing from the spirit of the present invention. The accompanying claims and equivalents thereto are intended to cover such forms or modifications as would fall within the scope and spirit of the present invention.

In addition, objects or effects disclosed herein should not be construed as limiting the scope of the present invention, since disclosure thereof does not mean that a specific embodiment should include all or only such effects.

Hereinafter, technical configuration capable of effectively achieving features of the present invention and advantages thereof will be described in detail in conjunction with exemplary embodiments and the accompanying drawings.

Figure 1:
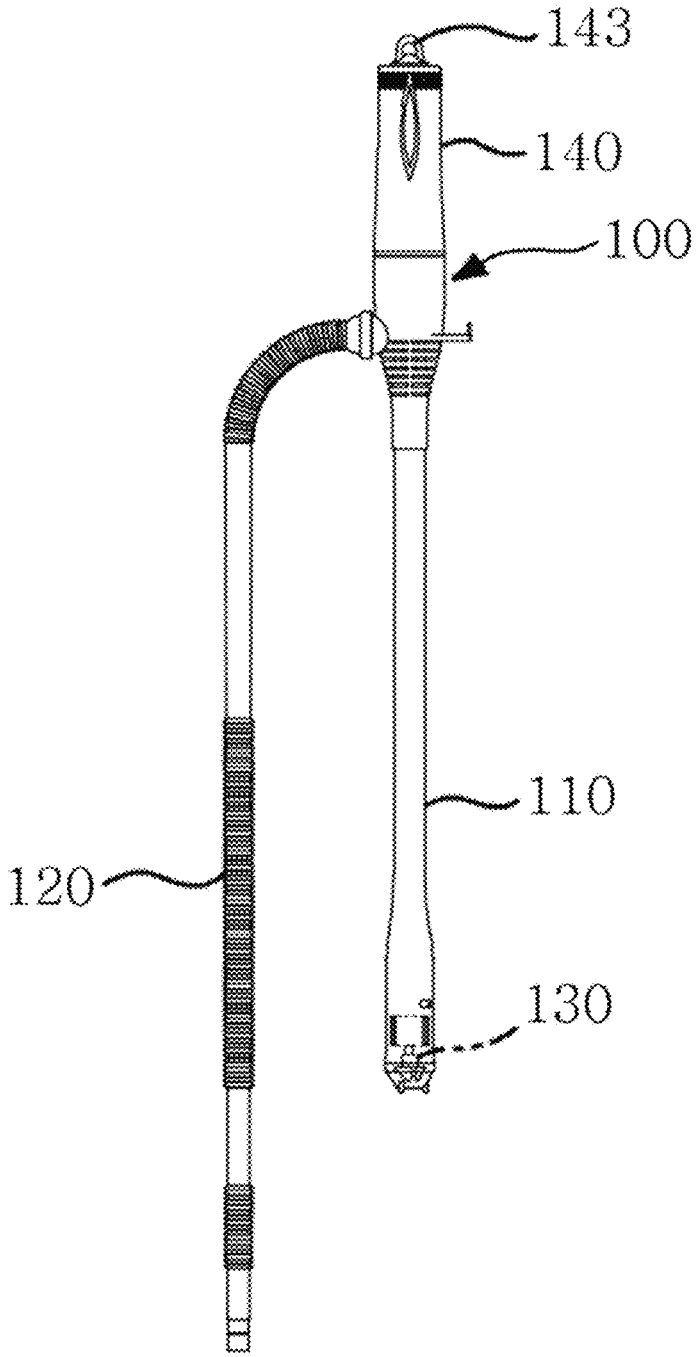
FIG. 1 is a front view of a fluid pump according to the present invention.
Figure 2:
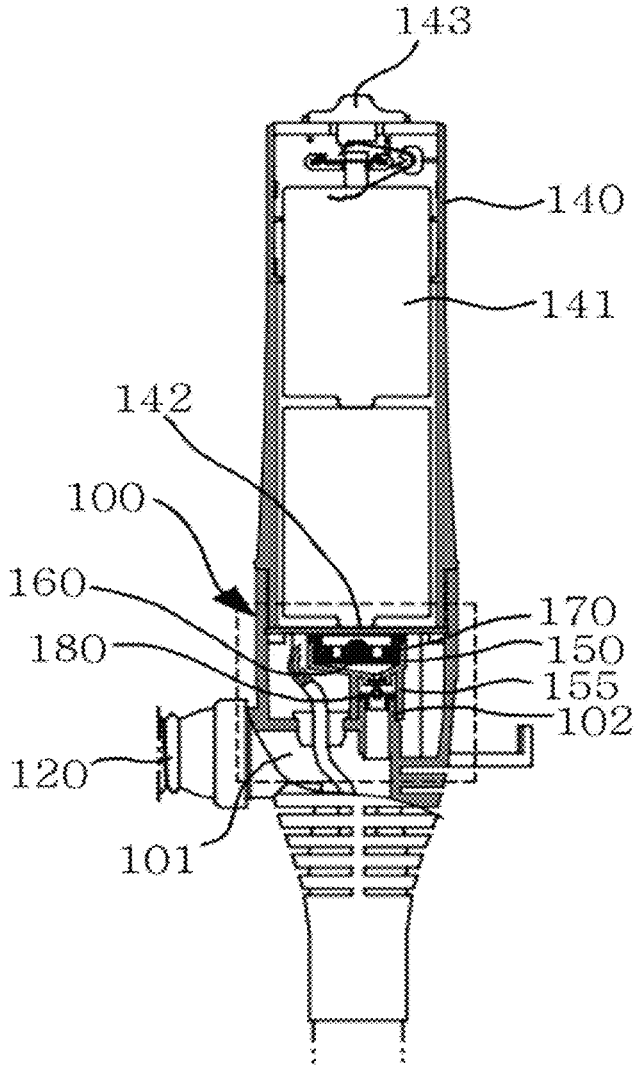
FIG. 2 is a sectional view of a pump body and a power controller of the fluid pump according to the present invention.
Figure 3:
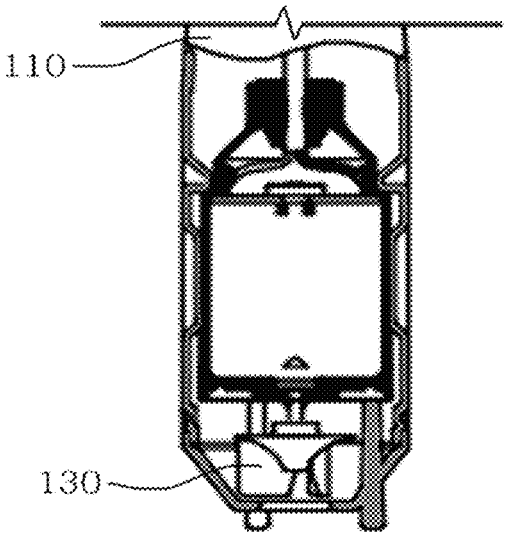
FIG. 3 is a sectional view of a suction pipe of the fluid pump according to the present invention, with a motor fan disposed in the suction pipe.
Figure 4:
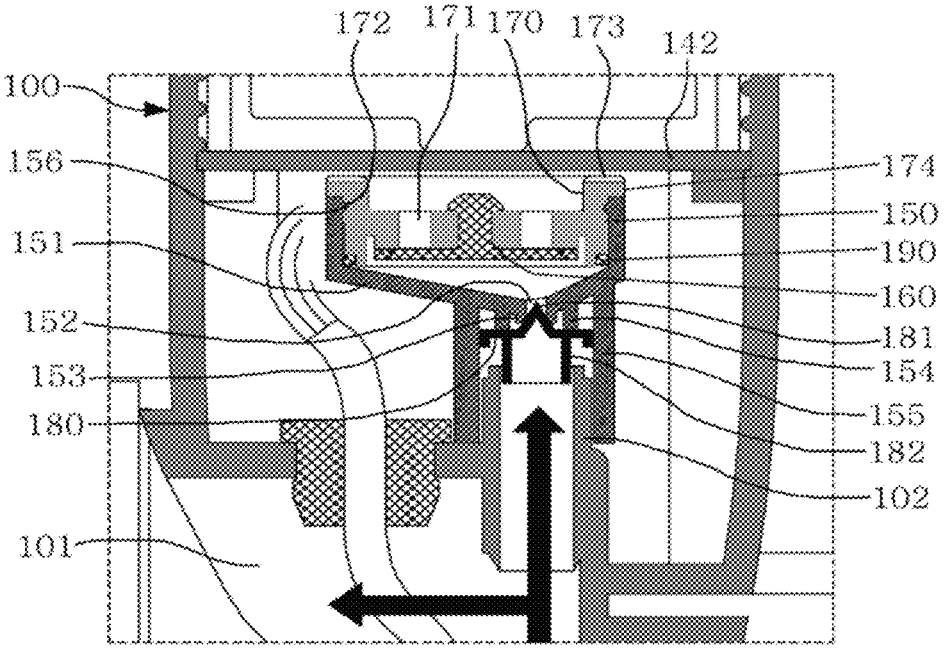
FIG. 4 is an enlarged sectional view of an auxiliary check valve and a main check valve according to the present invention, wherein the auxiliary check valve and the main check valve are both in a closed position.
Figure 5:
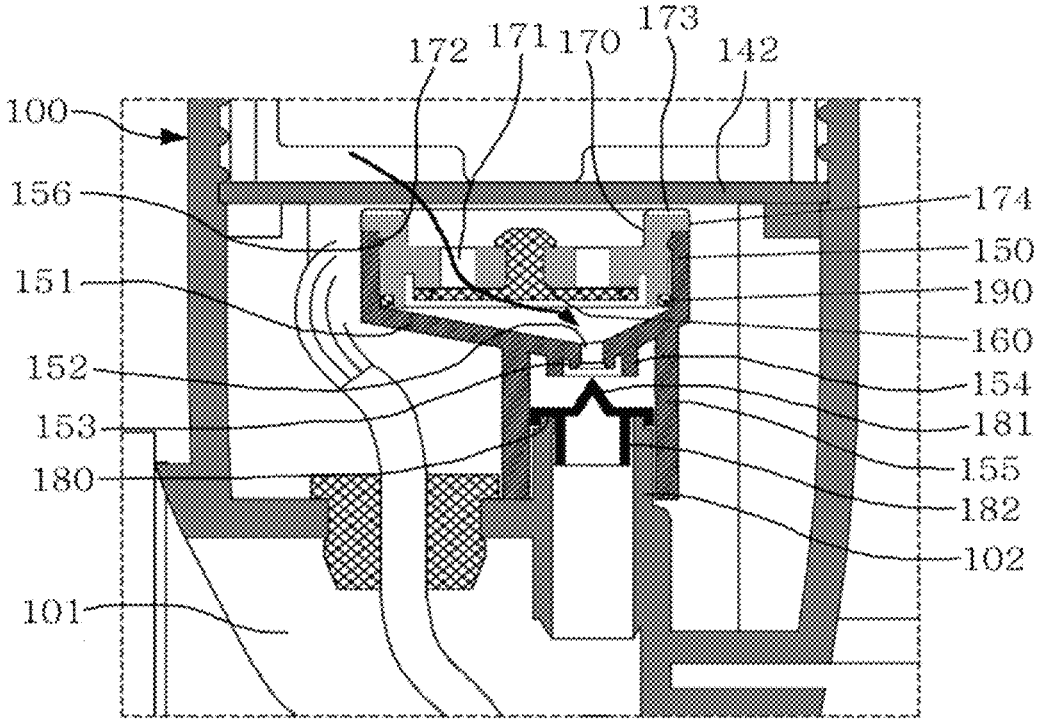
FIG. 5 is an enlarged sectional view of the auxiliary check valve and the main check valve according to the present invention, wherein the auxiliary check valve and the main check valve are both in an open position.

FIG. 1 is a front view of a fluid pump according to the present invention, FIG. 2 is a sectional view of a pump body and a power controller of the fluid pump according to the present invention, FIG. 3 is a sectional view of a suction pipe of the fluid pump according to the present invention, with a motor fan disposed in the suction pipe, FIG. 4 is an enlarged sectional view of an auxiliary check valve and a main check valve according to the present invention, wherein the auxiliary check valve and the main check valve are both in a closed position, and FIG. 5 is an enlarged sectional view of the auxiliary check valve and the main check valve according to the present invention, wherein the auxiliary check valve and the main check valve are both in an open position.

An automatic fluid pump according to the present invention includes: a pump body 100; a motor fan 130; a power controller 140; a valve case 150; a valve case cap 170, and a main check valve 160.

The pump body 100 has an inlet and an outlet formed at opposite ends thereof and connected to a suction pipe 110 and a delivery hose 120, respectively. In addition, the pump body includes a liquid channel 101 formed therein and communicating with the inlet and the outlet and a mounting channel 102 formed at an upper side of the liquid channel 101.

The motor fan 130 is disposed inside a lower end of the suction pipe 110 and directs fluid to the liquid channel 101. The power controller 140 is disposed above the mounting channel 102 of the pump body 100 and is circuit-connected to a battery 141, a terminal plate 142, and a switch 143 to control an operation of turning the motor fan 130 on/off.

The valve case 150 is in the form of a hopper formed at a lower end thereof with an inclined portion 151 having an air hole 152 formed therethrough, and is coupled to an inside of the pump body 100 by fitting a guide tube 155 formed at a lower surface of the inclined portion 151 into the mounting channel 102 of the pump body 100.

The valve case cap 170 is mounted on an upper surface of the valve case 150, and has multiple through-holes 171 along an edge thereof.

The main check valve 160 is disposed at a lower surface of the valve case cap 170 to open/close the through-holes 171 of the valve case cap 170. The main check valve 160 adjusts the amount of fluid introduced into the valve case 150 by increasing the internal pressure of the valve case 150 during pumping operation and is opened to allow external air to be introduced into the valve case 150 through the through-holes 171 when the pump is in a switch-off mode.

In one embodiment, among the main check valve 160 and an auxiliary check valve 180 shown in FIG. 4, only the main check valve 160 may be disposed in the pump body 100.

That is, when the suction pipe 110 is inserted into a fluid reservoir with only the main check valve 160 disposed in the pump body 100 and then a switch 143 of the power controller 140 is moved to a switch-on position, the motor fan 130 disposed inside the lower end of the suction pipe 110 is operated to direct fluid to the liquid channel 101 inside the pump body 100 such that the fluid is discharged to the delivery hose 120 connected to the outlet.

Here, some portion of the fluid introduced into the liquid channel 101 flows into and accumulates in a space in the valve case 150, which is a fluid retention portion, through the air hole 152. Here, since the valve case cap 170 with the main check valve 160 disposed thereon is mounted on the upper surface of the valve case 150, air inside the valve case 150 cannot escape to the outside.

As a result, air pressure inside the valve case 150 gradually increases as the fluid flows into the valve case 150 through an auxiliary check valve 180. When the air pressure in the valve case 150 reaches a certain value, no more fluid flows into the valve case 150, whereby overflow can be prevented.

In addition, even though back pressure is applied to the interior of the valve case 150 when the fluid pump is used for a long time, rapid increase in air pressure induced by the main check valve 160 allows up to a certain amount of fluid to flow into the valve case 150.

Accordingly, foreign matter contained in fluid is not likely to adhere to the main check valve 160, thereby preventing reduction in sealing force due to the foreign matter, and fluid pumped from the fluid reservoir can be entirely discharged through the delivery hose 120 without occurrence of overflow as in the related art.

In another embodiment, the fluid pump according to the present invention may further include an auxiliary check valve 180 disposed in the guide tube 155 to be movable up and down to open/close the air hole 152.

When there is fluid flowing upward through the mounting channel 102 from the liquid channel 101, the auxiliary check valve 180 is moved up by the fluid to primarily block the air hole 152 formed at the inclined portion 151 of the valve case 150.

In addition, even though sealing force is reduced due to back pressure or foreign matter adhered to the auxiliary check valve 180, no more fluid flows into the space (the fluid retention portion) in the valve case 150 when the internal pressure of the valve case 150 reaches a certain value, thereby allowing up to a certain amount of fluid to be introduced into the space, as described above.

Preferably, the valve case 150 includes a first contact portion 153 and a second contact portion 154 formed on the lower surface of the inclined portion 151 and having different heights, in which the first contact portion 153 and the second contact portion 154 contact a mountain-shaped protrusion 181 of the auxiliary check valve 180 and the auxiliary check valve 180, respectively, and the auxiliary check valve 180 includes a guide portion 182 formed at the lower surface thereof and fitted at one end thereof into the mounting channel 102 to guide vertical movement of the auxiliary check valve 180.

In this way, the auxiliary check valve 180 can be smoothly moved up/down by means of the guide portion 182 upon performing opening/closing operations during pumping operation. In addition, the auxiliary check valve 180 contacts both the first contact unit 153 and the second contact unit 154 when in a closed position, thereby providing improved sealing force.

Further, when the pump is stopped, the auxiliary check valve 180 is quickly released from contact with the first contact unit 153 and the second contact unit 154 while being vertically moved down, thereby allowing fluid introduced into and having remained in the valve case 150 to be quickly recovered through the air hole 152.

In addition, the fluid being quickly recovered from the valve case 150 through the air hole 152 can effectively wash off foreign matter off the auxiliary check valve 180. Further, according to the present invention, improved sealing force can be achieved by dual action of the main check valve 160 and the auxiliary check valve 180.

In addition, a locking protrusion 156 and a locking groove 172 corresponding to each other may be formed in an inner surface of the valve case 150 and an outer surface of the valve case cap 170, respectively, to maintain firm engagement between the valve case and the valve case cap 170. Further, the valve case cap 170 may be provided on a lower outer surface thereof with an O-ring 190 for airtightness, thereby helping to increase the pressure in the valve case 150.

Preferably, the valve case cap 170 is provided at the upper end thereof with a flange 174 having multiple grooves 173 such that an air passage is generated between the valve case cap 170 and the terminal plate 142 disposed on the valve case cap 170.

In this way, even when the edge of the valve case cap 170 closely contacts a lower surface of the terminal plate 142, a smooth flow of air can be secured through the grooves 173 of the flange 174, thereby allowing external air to be smoothly introduced into the valve case 150, in which fluid remains, through the main check valve 160 when the fluid pump is in a switch-off mode.

LIST OF REFERENCE NUMERALS

| | |
|---|---|
| 100: Pump body | 101: Liquid channel |
| 102: Mounting channel | 110: Suction pipe |
| 120: Delivery hose | 130: Motor fan |
| 140: Power controller | 150: Valve case |
| 151: Inclined portion | 152: Air hole |
| 153: First contact portion | 154: Second contact portion |
| 155: Guide tube | 156: Locking protrusion |
| 160: Main check valve | 170: Valve case cap |
| 171: Through-hole | 172: Locking groove |

-continued

| | |
|---|---|
| 173: Groove | 174: Flange |
| 180: Auxiliary check valve | 181: Mountain-shaped protrusion |
| 182: Guide portion | 190: O-ring |

What is claimed is:

1. An automatic fluid pump adapted to pump fluid using a motor fan, the automatic fluid pump comprising:

a pump body having an inlet and an outlet formed at opposite ends thereof and connected to a suction pipe and a delivery hose, respectively, the pump body comprising a liquid channel formed therein and communicating with the inlet and the outlet and a mounting channel formed at an upper side of the liquid channel;

a valve case provided in the form of a hopper formed at a lower end thereof with an inclined portion having an air hole, the valve case comprising a guide tube formed on a lower surface of the inclined portion and coupled to the mounting channel of the pump body to allow the fluid to be introduced into the valve case therethrough;

a valve case cap coupled to the valve case and having multiple through-holes; and a main check valve disposed on a lower surface of the valve case cap to open/close the through-holes, the main check valve controlling the amount of the fluid introduced into the valve case by increasing internal pressure of the valve case during pumping operation, whereby overflow due to back pressure and intrusion of foreign matter is prevented during pumping operation.

2. The automatic fluid pump according to claim 1, further comprising:

an auxiliary check valve disposed inside the guide tube to be movable up and down, the auxiliary check valve being adapted to open/close the air hole, whereby sealing force is improved by dual action of the main check valve and the auxiliary check valve.

3. The automatic fluid pump according to claim 2, wherein:

the valve case comprises a first contact portion and a second contact portion formed on a lower surface of the inclined portion and having different heights, the first contact portion having a greater height than the second contact portion;

the auxiliary check valve comprises a mountain-shaped protrusion formed on a surface thereof such that the first contact portion is opened/closed by the mountain-shaped protrusion and the second contact portion is opened/closed by the auxiliary check valve, whereby a dual opening/closing mechanism is provided; and the auxiliary check valve comprises a guide portion formed on a lower surface thereof and fitted at one end thereof into the mounting channel to guide vertical movement of the auxiliary check valve.

4. The automatic fluid pump according to claim 1, wherein:

a locking protrusion and a locking groove corresponding to each other are formed on an inner surface of the valve case and an outer surface of the valve case cap, respectively, to maintain firm engagement between the valve case and the valve case cap; and the valve case cap is provided with an O-ring for sealing to effectively maintain the internal pressure of the valve case.

5. The automatic fluid pump according to claim 1, wherein the valve case cap comprises a flange formed at an upper end thereof and having multiple vent grooves to generate an air passage between the valve case cap and a terminal plate disposed on the valve case cap, whereby external air is smoothly introduced into the valve case, in which the fluid remains, through the main check valve when the automatic fluid pump is in a switch-off mode.

* * * * *